US008104757B2

(12) United States Patent
Taki et al.

(10) Patent No.: US 8,104,757 B2
(45) Date of Patent: Jan. 31, 2012

(54) SHEET FINISHING APPARATUS, SHEET FINISHING METHOD, AND IMAGE FORMING APPARATUS

(75) Inventors: Hiroyuki Taki, Shizuoka (JP); Hiroyuki Tsuchihashi, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 262 days.

(21) Appl. No.: 12/612,326

(22) Filed: Nov. 4, 2009

(65) Prior Publication Data

US 2010/0117288 A1 May 13, 2010

Related U.S. Application Data

(60) Provisional application No. 61/114,017, filed on Nov. 12, 2008, provisional application No. 61/114,011, filed on Nov. 12, 2008.

(51) Int. Cl.
*B65H 37/04* (2006.01)

(52) U.S. Cl. ..... 270/58.09; 270/58.08; 270/58.18; 270/58.11; 399/410

(58) Field of Classification Search ..... 270/58.08, 270/58.09, 58.11, 58.18, 58.19; 399/410
See application file for complete search history.

(56) References Cited

U.S. PATENT DOCUMENTS

| | | | | |
|---|---|---|---|---|
| 5,573,233 | A * | 11/1996 | Hirai et al. | 270/58.08 |
| 6,398,203 | B1 | 6/2002 | Saito et al. | |
| 7,284,752 | B2 * | 10/2007 | Nagata et al. | 270/58.18 |
| 7,500,667 | B2 * | 3/2009 | Miyazaki et al. | 271/189 |
| 7,954,800 | B2 * | 6/2011 | Maeda et al. | 270/58.11 |
| 7,995,962 | B2 * | 8/2011 | Matsuo | 399/410 |
| 2010/0158567 | A1 * | 6/2010 | Jeon | 399/124 |

FOREIGN PATENT DOCUMENTS

| | | | |
|---|---|---|---|
| JP | 3-70907 | U | 3/1991 |
| JP | 4-305000 | A | 10/1992 |
| JP | 6-340366 | A | 12/1994 |
| JP | 2001-130827 | A | 5/2001 |
| JP | 2003-306268 | A | 10/2003 |
| JP | 2004-250114 | A | 9/2004 |

* cited by examiner

*Primary Examiner* — Patrick Mackey
(74) *Attorney, Agent, or Firm* — Patterson & Sheridan, LLP

(57) ABSTRACT

A stapler is provided in a housing of a finisher. The stapler has a sheet insertion opening extending in a direction along conveyed sheets. The stapler staples the sheets inserted into the sheet insertion opening in the housing. The finisher includes a rotating mechanism that rotates, when the stapler is moved in a direction orthogonal to a conveying direction of the sheets and removed to the outside of the housing, the stapler such that the sheet insertion opening of the stapler faces a further upper side than the direction along the sheets.

20 Claims, 9 Drawing Sheets

SHEET FINISHING APPARATUS, SHEET FINISHING METHOD, AND IMAGE FORMING APPARATUS

CROSS-REFERENCE TO RELATED APPLICATION

This application is based upon and claims the priority of U.S. Provisional Application No. 61/114,017, filed on Nov. 12, 2008, and U.S. Provisional Application No. 61/114,011 filed on Nov. 12, 2008, the entire contents of which are incorporated herein by reference.

TECHNICAL FIELD

The present invention relates to a sheet finishing apparatus and a sheet finishing method for performing finishing of sheets discharged from an image forming apparatus such as a copying machine, a printer, and a multi function peripheral (MFP) and the image forming apparatus and, more particularly to improvement of a stapler that staples sheets and a punch unit that opens punch holes in the sheets.

BACKGROUND

In recent years, in an image forming apparatus (e.g., a MFP), a sheet finishing apparatus is provided adjacent to a post stage of the MFP in order to apply finishing to sheets after image formation. The sheet finishing apparatus is called finisher. The sheet finishing apparatus staples sheets fed from the MFP or opens punch holes in the sheets and discharges the sheets from a discharge port to a storage tray.

In the past, a user operates an operation unit provided in the image forming apparatus to instruct the sheet finishing apparatus to perform stapling or punching of punch holes. However, if the user fails to perform the operation, sheets are discharged without being subjected to finishing. Therefore, in applying the stapling or the punching of punch holes to the sheets after the sheets are discharged, necessary to convey the sheets to the finisher again with an inserter. Alternatively, the user needs to insert the sheets from the discharge port and staple the sheets.

JP-A-06-340366 discloses an image forming apparatus incorporating a stapler. In the image forming apparatus disclosed in JP-A-06-340366, an auxiliary stapler is provided besides the incorporated stapler. The auxiliary stapler can be removed to the outside of the image forming apparatus. Sheets exceeding a stapling capacity of the incorporated stable are stapled by the auxiliary stapler. However, JP-A-06-340366 is necessary to separately provide the incorporated stapler and the auxiliary stapler.

JP-A-2004-250114 discloses a paper feeding apparatus including a punch unit detachably attachable to an image forming apparatus. When a jam occurs in the paper feeding apparatus disclosed in JP-A-2004-250114, the punch unit is drawn out for maintenance. However, when the punch unit is drawn out, punch holes cannot be opened.

SUMMARY

It is an object of the present invention to provide a sheet finishing apparatus with which a user can manually staple sheets by removing a stapler from a finisher.

According to an aspect of the present invention, there is provided a sheet finishing apparatus including:

a tray that supports sheets;

a housing that supports the tray;

a stapler that staples the sheets, which are supported by the tray, in a sheet insertion opening extending in a direction along the sheets in the housing;

a driving mechanism that moves the stapler in a direction orthogonal to a conveying direction of the sheets and removes the stapler to the outside of the housing; and a rotating mechanism that rotates, when the stapler is removed to the outside of the housing, the stapler such that the sheet insertion opening of the stapler faces a further upper side than the direction along the sheets.

DETAILED DESCRIPTION

Figure 1:
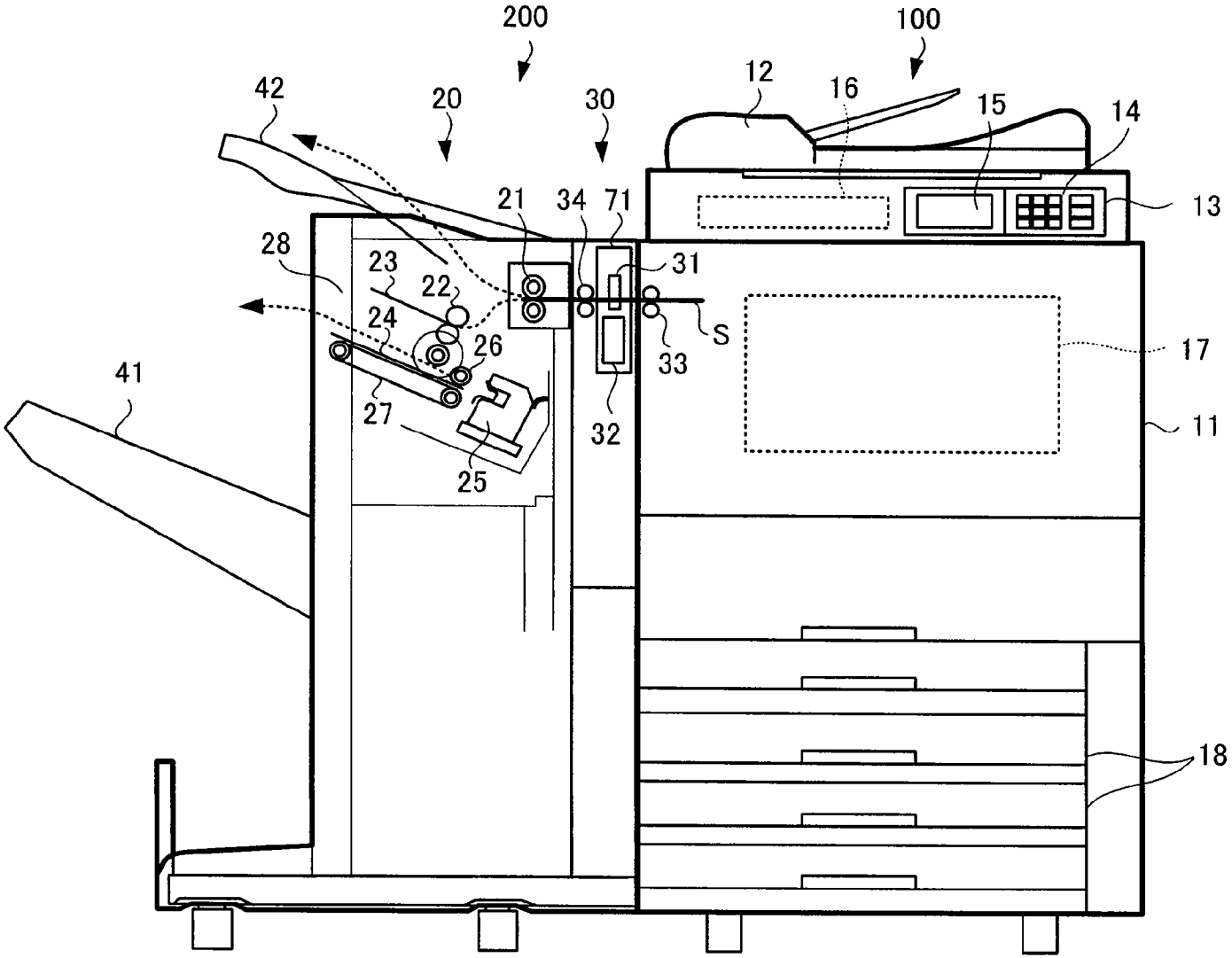
FIG. 1 is an overall diagram of a sheet finishing apparatus according to an embodiment.

Throughout this description, the embodiments and examples shown should be considered as exemplars, rather than limitations on the apparatus of the present invention.

A sheet finishing apparatus according to an embodiment of the present invention is explained in detail below with reference to the accompanying drawings. In the drawings, the same components are denoted by the same reference numerals and signs.

FIG. 1 is a diagram of an image forming apparatus including the sheet finishing apparatus.

In FIG. 1, reference numeral 100 denotes the image forming apparatus such as a multi function peripheral (MFP), a printer, or a copying machine. A sheet finishing apparatus 200 is arranged adjacent to the image forming apparatus 100. A sheet on which an image is formed by the image forming apparatus 100 is conveyed to the sheet finishing apparatus 200.

The sheet finishing apparatus 200 performs finishing such as punching or stapling for sheets fed from the image forming apparatus 100. The sheet finishing apparatus 200 is hereinafter referred to as finisher 200.

In FIG. 1, a document table is provided in an upper part of a main body 11 of the image forming apparatus 100. An auto document feeder (ADF) 12 is openably and closably provided on the document table. An operation panel 13 is provided in the upper part of the main body 11. The operation panel 13 includes an operation unit 14 including various keys and a display unit 15 of a touch panel type.

The main body 11 includes a scanner unit 15 and a printer unit 17 in the inside thereof. Plural cassettes 18 in which sheets of various sizes are stored are provided in a lower part of the main body 11. The scanner unit 16 reads a document fed by the ADF 12 or a document placed on the document table.

The printer unit 17 includes a photoconductive drum and a laser. The printer unit 17 scans and exposes the surface of the photoconductive drum with a laser beam from the laser and forms an electrostatic latent image on the photoconductive drum. A charger, a developing device, a transfer device, and the like are arranged around the photoconductive drum. The developing device develops the electrostatic latent image on the photoconductive drum to form a toner image on the photoconductive drum. The transfer device transfers the toner image onto a sheet. The configuration of the printer unit 17 is not limited to the example explained above. There are various types as the configuration of the printer unit 17.

Sheets on which images are formed by the main body 11 are conveyed to the finisher 200. In an example shown in FIG. 1, the finisher 200 includes a staple unit 20 that staples a sheet bundle and a punch unit 30 that makes punch holes in sheets. The sheets subjected to finishing by the finisher 200 are discharged to a storage tray 41 or a stationary tray 42.

The staple unit 20 is explained below. A sheet S fed from the punch unit 30 is received by an inlet roller 21 of the staple unit 20 via a conveying roller 34. A paper feeding roller 22 is provided on a downstream side of the inlet roller 21. The paper feeding roller 22 feeds the sheet S received by the inlet roller 21 to a standby tray 23. The input roller 21 and the paper feeding roller 22 include upper rollers and lower rollers, respectively, and are driven by motors.

A processing tray 24 on which the sheet S dropping from the standby tray 23 is stacked is arranged below the standby tray 23. The sheet S is stacked on the standby tray 23. The standby tray 23 has an openable structure. When a predetermined number of sheets S are stored, the standby tray 23 opens and the sheets S drops to the processing tray 24 because of own weight or the operation of a drop support member. While the sheets S are stapled by the stapler 25, the sheets S are aligned and stacked on the processing tray 24.

The sheets stacked on the processing tray 24 are guided to the stapler 25 by a vertical aligning roller 26 and stapled. A conveyor belt 27 that conveys the stapled sheets S to the storage tray 41 is provided in the staple unit 20. The sheets S conveyed by the conveyor belt 27 is discharged to the storage tray 41 via a discharge port 28. The storage tray 41 rises and falls to receive the sheets S. In some cases, the sheets S are discharged to the storage tray 41 without being stapled. When the sheets S are not stapled, the sheets S are discharged without being dropped to the processing tray 24.

The staple unit 20 includes an aligning device that aligns sheets conveyed in the width direction. The staple unit 20 can also sort and discharge the sheets using the aligning device. When the finishing is not performed, the staple unit 20 directly discharges the sheets conveyed from the main body 11 to the storage tray 41 or the stationary tray 42.

On the other hand, the punch unit 30 is arranged between the main body 11 and the staple unit 20 and includes a punch box 71. The punch box 71 includes a puncher 31 that applies punching to sheets and a dust box 32. The puncher 31 has a punching blade that descends to make punch holes in the sheets. Punch dust caused by the punching drops to the dust box 32.

Plural rollers 33 and 34 for sheet conveyance are provided in a path reaching from the main body 11 to the staple unit 20. The main body 11 supports the roller 33. The roller 34 is provided at a last outlet of the punch unit 30. The roller 33 conveys a sheet discharged from the main body 11 to the punch unit 30. The roller 34 conveys the sheet to the staple unit 20. The punching by the punch unit 30 is performed when a user operates the operation panel 13 to set a punch mode.

Figure 2:
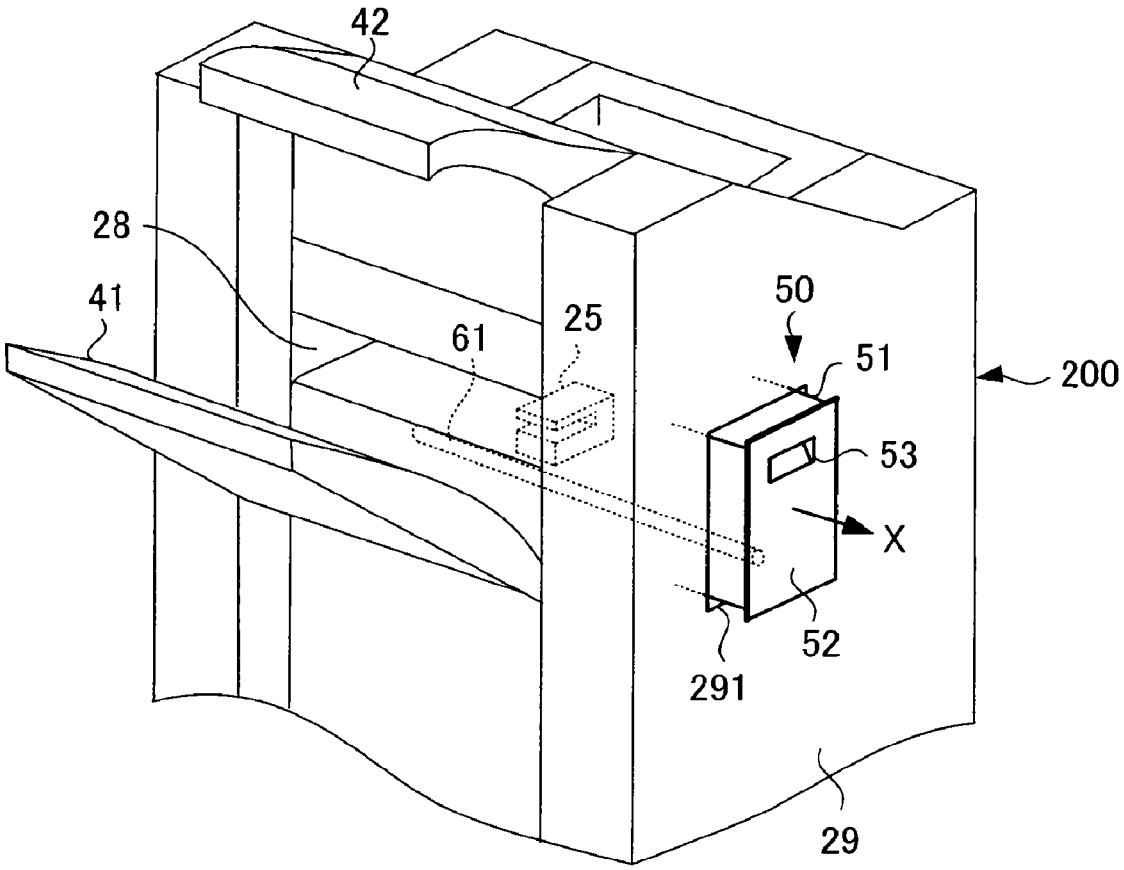
FIG. 2 is a perspective view of a removing and inserting mechanism for a stapler.

FIG. 2 is a perspective view of a removing and inserting mechanism for the stapler. When the user fails to operate the stapler or staples sheets after the sheets are discharged to the storage tray 41, in the past, the user needs to insert the sheets from the discharge port 28 or convey the sheets to the finisher 200 again using an inserter and staple the sheets. In the staple unit 20 according to this embodiment, the user can staple the sheets by removing the stapler 25 to the outside of a housing a removing and inserting mechanism 50.

In FIG. 2, the removing and inserting mechanism 50 includes a box 51 that can be removed from and inserted into the finisher 200. A pull 53 is provided on a front surface 52 of the box 51. The box 51 can be removed from and inserted into the finisher 200 via an opening 291 formed in the front surface of a housing 29. The opening 291 is provided in a position opposed to the stapler 25.

In FIG. 2, a state in which the box 51 is removed a little is shown. Usually, the box 51 is inserted in the housing 29. The opening 291 is covered by the front surface 52 of the box 51. When the box 51 is removed in an X direction from the front surface of the housing 29, the stapler 25 moves in the direction of the opening 291 and, when out of the housing 29, the stapler 25 rotates about 90 degrees.

Figure 3:
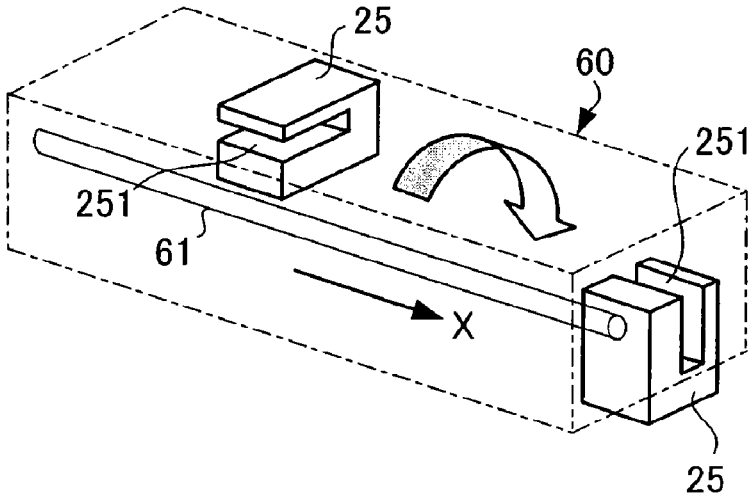
FIG. 3 is a schematic perspective view of a rotating mechanism for the stapler.

FIG. 3 is a schematic perspective view of a rotating mechanism 60 for the stapler 25. The stapler 25 is attached to a shaft 61 and has a sheet insertion opening 251. The sheet insertion opening 251 extends in a direction along the processing tray 24 and sheets in a state in which the stapler 25 is housed in the housing 29. The stapler 25 staples, in the sheet insertion opening 251, sheets supported by the processing tray 24. The direction along the processing tray 24 and the sheets includes directions deviating in a range in which the sheets are not bent by the stapler 25 when the sheets are stapled.

On the other hand, when the box 51 is removed from the housing 29, the stapler 25 moves in the direction of the opening 291 (the arrow X direction) along the shaft 61 according to the removal of the box 51 and, when out of the opening 291, rotates 90 degrees. The sheet insertion opening 251 faces an upward direction, i.e., a further upper side than the direction along the sheets. The stapler 25 removed to the outside of the housing 29 is covered with the box 51. Details of the rotating mechanism 60 for the stapler 25 are explained later with reference to FIGS. 5 and 6.

Figure 4A:
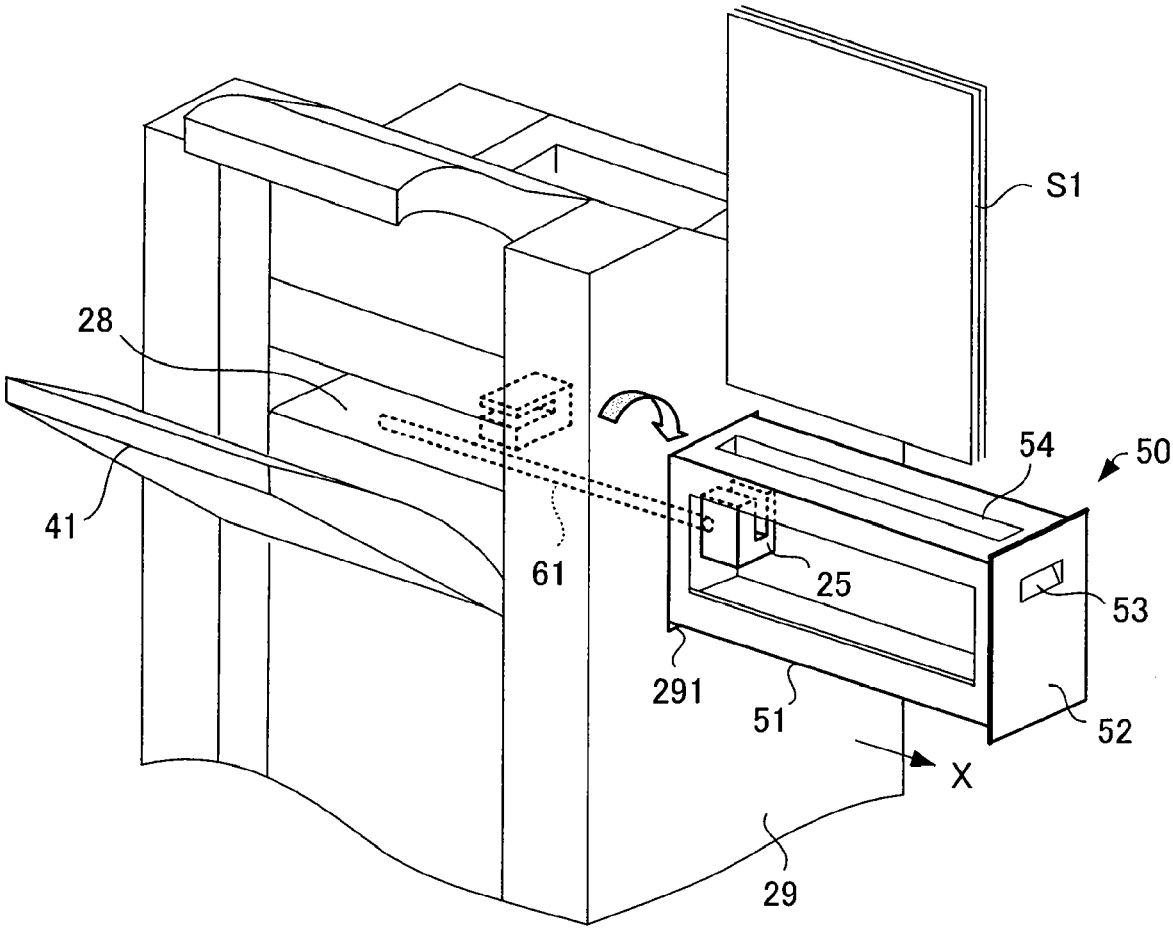
FIG. 4A is a perspective view of a state in which the stapler is removed from a housing.

FIG. 4A is a perspective view of a state in which the box 51 is removed farthest from the housing 29. The box 51 does not completely come off from the opening 291. A stopper is provided to prevent the box 51 from falling off from the opening 291.

When the box 51 is removed from the inside of the housing 29, the stapler 25 is also removed from the housing 29 and located on the innermost side in the box 51. The stapler 25 projects a little beyond the opening 291 and rotates such that the sheet insertion opening 251 faces the upper side.

A guide slit 54 in which a sheet bundle S1 can be inserted is provided in the upper surface of the box 51. When the sheet bundle S1 is inserted from the guide slit 54, a corner of the sheet bundle S1 is guided to the sheet insertion opening 251 of the stapler 25. Even when the box 51 is removed from the housing 29, since the main body of the finisher 200 and the stapler 25 are electrically connected by a cable, stapling is executed by the user operating the operation unit 14 to send an instruction for stapling to the finisher 200. Alternatively, also possible to attach a sensor to the stapler 25, detect, with the sensor, that sheets are inserted into the sheet insertion opening 251 when the stapler 25 is rotating upward, and automatically staple the sheets.

Figure 4B:
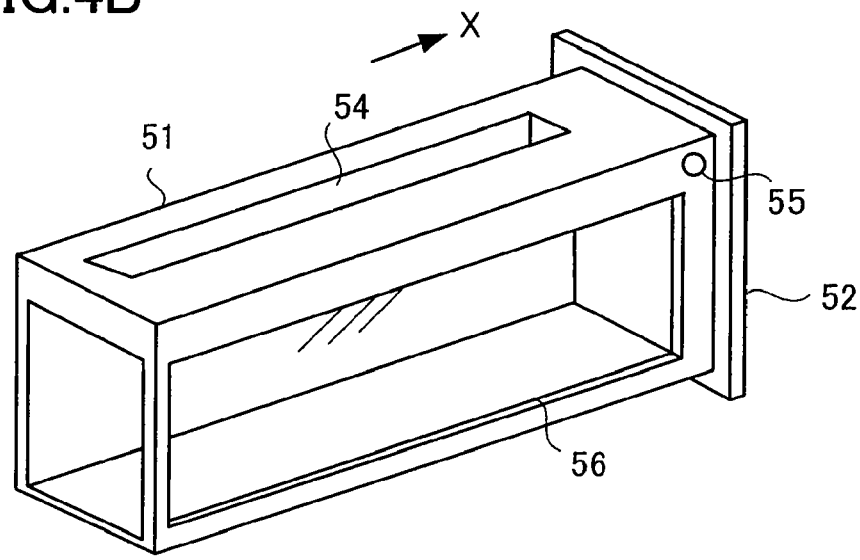
FIG. 4B is a perspective view of a box of the removing and inserting mechanism.

FIG. 4B is a perspective view of the box 51 viewed from the rear side of the front surface 52. A sensor 55 that detects the removal of the box 51 is attached to a side of the box 51. A window 56 is formed on a surface of the box 51 opposed to the discharge port 28. When the box 51 is housed in the housing 29, the sheets S can be sent to the stapler 25 via the window 56.

Figure 5:
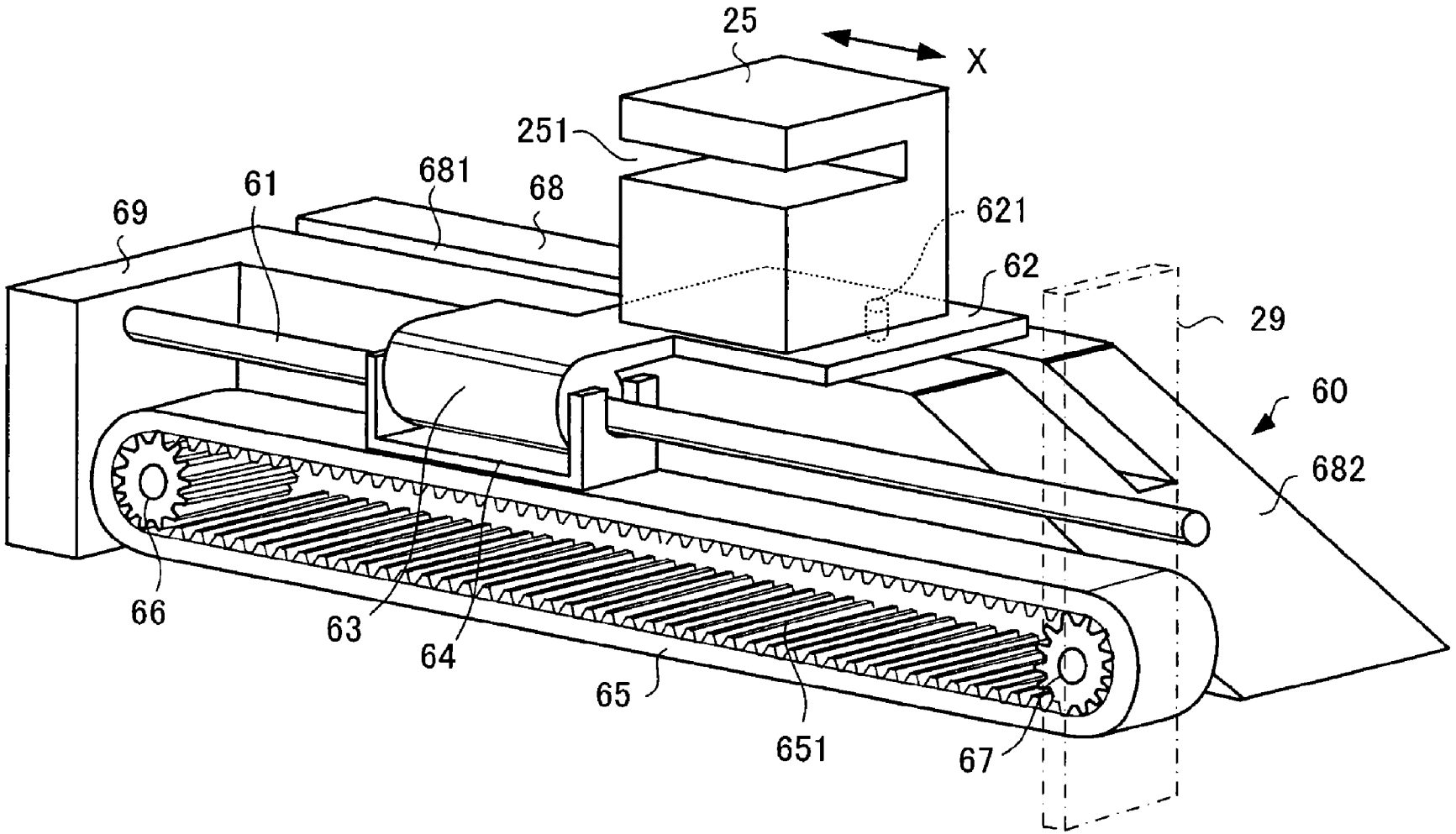
FIG. 5 is a perspective view of a driving mechanism for the stapler.

FIG. 5 is a perspective view of a driving mechanism including the rotating mechanism 60 for the stapler 25. In FIG. 5, the position of the front surface of the housing 29 is indicated by an alternate long and short dash line 29. The opening 291 is provided in the front surface of the housing 29. The stapler 25 is attached on a stage 62 movably in the direction X orthogonal to a sheet conveying direction. The stage 62 is integrated with a sleeve 63. The shaft 61 having a columnar shape pierces through the sleeve 63. A fork 64 is attached to the sleeve 63 to hold the sleeve 63 from both the sides in the axial direction. The fork 64 moves along the shaft 61.

The fork 64 is provided on an annular driving belt 65. A gear 651 is formed on the inner side of the driving belt 65. A driving pulley 66 and a driven pulley 67 that mesh with the gear 651 are provided at both the ends on the inner side of the driving belt 65. The driving pulley is rotated in normal and reverse directions by a stepping motor and rotates the driving belt 65. When the driving belt 65 rotates, the fork 64 moves along the shaft 61. The sleeve 63 and the stage 62 move in the arrow X direction. The fork 64 is set not to fall off from the tip of the shaft 61.

The stage 62 moves on a platform 68. In the platform 68, a groove rail 681 is formed in parallel to the shaft 61. A guide pin 621 provided at the bottom of the stage 62 fits in the groove rail 681 and guides the stage 62 when the stage 62 moves on the platform 68.

A slope 682 gradually reduced in height toward a direction in which the stapler 25 is removed from the housing 29 is formed at the terminal end on the opening 291 side of the platform 68. One end of the shaft 61 is supported by a support unit 69 provided orthogonally to the end on the inner side of the platform 68. The terminal end of the shaft 61 extends to the opening 291 side.

In FIG. 5, when the stepping motor rotates the driving pulley 66 in a state in which the box 51 is housed in the housing 29, the driving belt 65 laid over between the driving pulley 66 and the driven pulley 67 rotates. The fork 64 moves according to the rotation of the driving belt 66 and the sleeve 63 moves along the shaft 61.

Therefore, the stapler 25 moves along the rear end of sheets S according to the rotation of the stepping motor. The stapler 25 can staple, for example, two places at the rear end of the sheets S. Alternatively, the stapler 25 can staple a corner of the sheets S in a position closest to the left side. The stapler 25 staples the sheets S in a specified position.

On the other hand, when the box 51 is removed from the housing 29, the sensor 55 detects that the box 51 is removed. The stepping motor rotates. The driving belt 65 is rotated by the stepping motor and moves the fork 64 to the position of the opening 291. When the fork 64 reaches the position of the opening 291 and the stapler 25 moves to the position of the opening 291, the stepping motor is deenergized.

Figure 6:
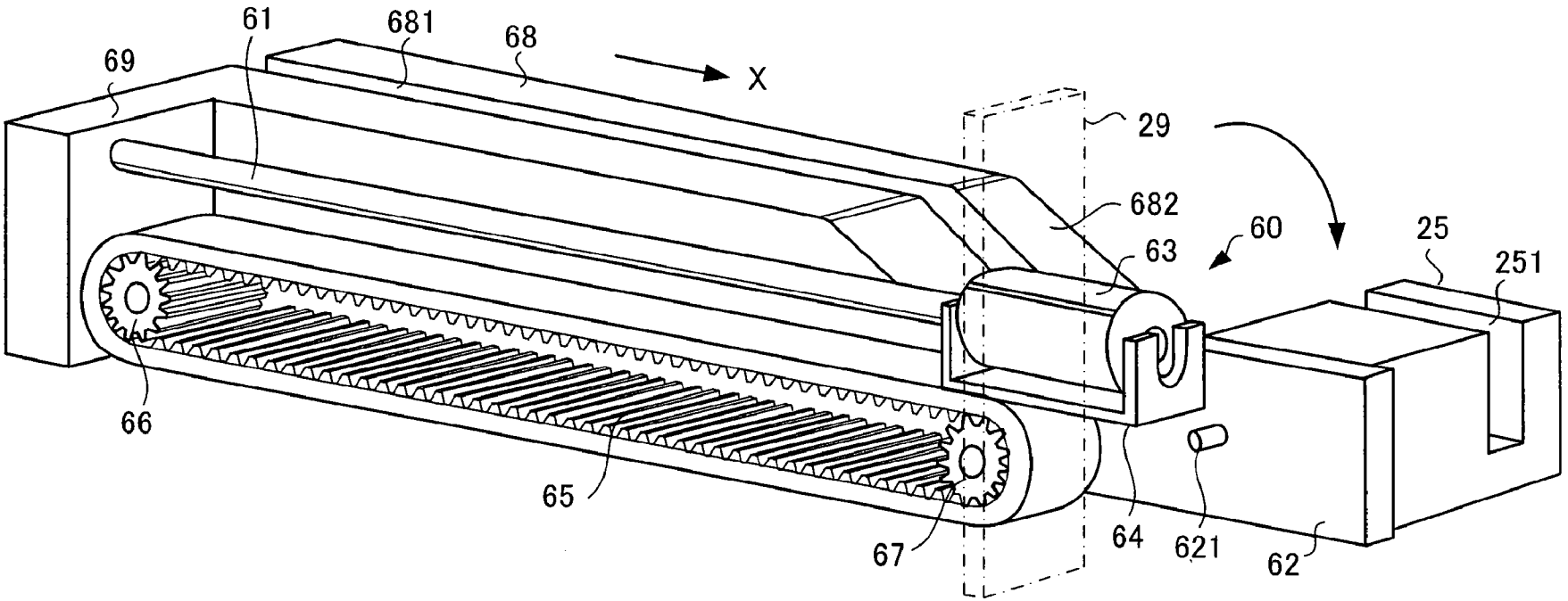
FIG. 6 is a perspective view for explaining the operation of the driving mechanism for the stapler.

A state in which the stapler 25 moves to the outside of the housing 29 is shown in FIG. 6. The sleeve 63 is located at the tip of the shaft 61. The stage 62 descends while sliding on the slope 682 and rotates together with the sleeve 63. Therefore, the stapler 25 also rotates and stops rotating in a state in which the sheet insertion opening 251 faces the upper side.

The stapler 25 moves to the outside of the housing 29 and located in the innermost position of the box 51. The stapler 25 is in the state shown in FIG. 4A. Therefore, when the sheet bundle S1 is inserted from the guide slit 54 of the box 51, a corner of the sheet bundle S1 is stapled by the stapler 25. Since the sheet bundle S1 is inserted from above the box 51 easy to staple the sheet bundle S1.

After the stapling, when the box 51 is housed in the housing 29, the stapler 25 is pushed in by the front surface 52 of the box 51 and raised by the slope 682 to rotate to an original state. Since the stepping motor is deenergized, unnatural force is not applied to the stapler 25 when the stapler 25 is returned onto the platform 68. When the box 51 is housed, the stapler 25 is located on the platform 68.

Also possible to, after the housing of the box 51 is detected by the sensor 55 and the stapler 25 rotates to the original position and rises, rotate the stepping motor to move the fork 64 to a predetermined position and move the stapler 25 to a home position. The sleeve 63, the stage 62, and the slope 682 configure the rotating mechanism 60.

A sheet finishing apparatus according to a second embodiment is explained. In the sheet finishing apparatus according to the second embodiment, the punch unit 30 is housed in a housing 301 of the finisher 200 such that the punch unit 30 can be removed by a removing and inserting mechanism 70.

Figure 7:
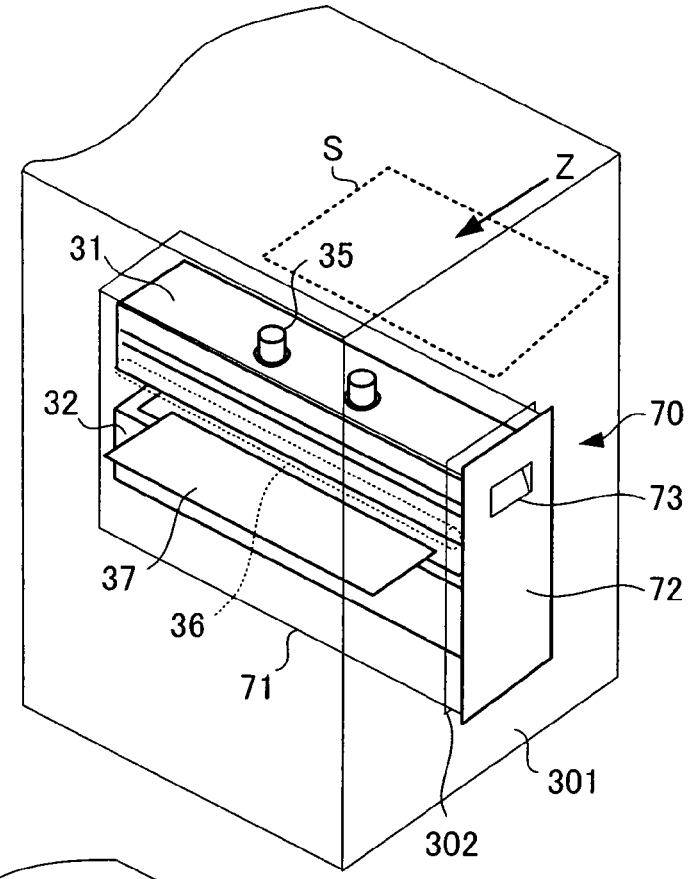
FIG. 7 is a perspective view of a removing and inserting mechanism for a punch unit.

In FIG. 7, the removing and inserting mechanism 70 includes a punch box 71 that can be removed from and inserted into the housing 301 of the finisher 200. A pull 73 is provided on a front surface 72 of the punch box 71. The punch box 71 can be removed and inserted via an opening 302 formed in the housing 301. A state in which the punch box 71 is removed a little is shown in FIG. 7.

Figure 8:
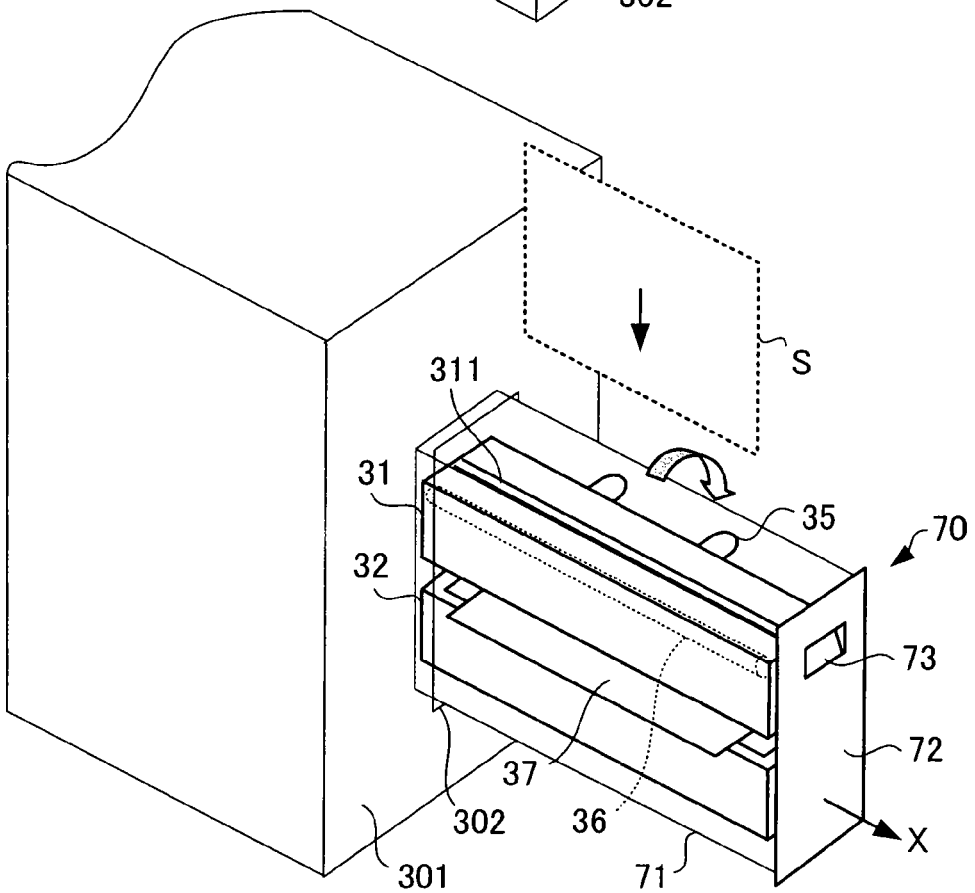
FIG. 8 is a perspective view of a state in which a punch box is removed from the housing.

The puncher 31 and the dust box 32 are stored in the punch box 71. In FIGS. 7 and 8, to clearly show the puncher 31 and the dust box 32, the punch box 71 is shown transparent with an outer hull of a main body indicated by a thin line.

The puncher 31 includes plural (two in FIG. 7) punching blades 35. The punching blades 35 rise and fall according to the rotation of a punch motor. In a state in which the punch box 71 is housed in the housing 301, the sheets S are conveyed in a Z direction, i.e., a conveying direction and pass through the puncher 31. The sheets S once stop while passing through the puncher 31. The punching blades 35 fall in a paper surface direction of the sheets S to drill punch holes in the sheets S. An elevating mechanism for the punching blades 35 is generally well-known. Punch dust caused by the punching is stored in the dust box 32.

On the other hand, as shown in FIG. 8, when the punch box 71 is pulled out from the opening 302 of the housing 301 in the X direction, the puncher 31 and the dust box 32 are also pulled out from the opening 302 together with the punch box 71. The puncher 31 rotates about 90 degrees in a state in which the punch box 71 is removed farthest from the housing 301.

A shaft 36 (indicated by a dotted line) is attached in an eccentric position of the puncher 31. The puncher 31 rotates around the shaft 36 according to the removal of the punch box 71. A mechanism for rotating the puncher 31 is explained later with reference to FIG. 11. In FIG. 8, the punch box 71 does not completely come off from the opening 302. A stopper is provided to prevent the punch box 71 from falling off from the opening 302.

Figure 10:
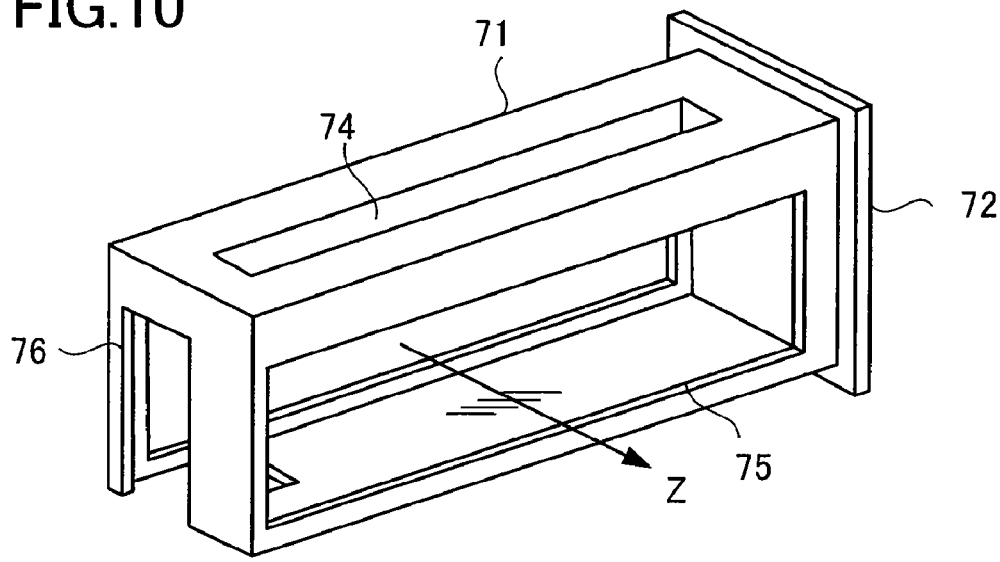
FIG. 10 is a perspective view of the punch box.

When the punch box 71 is removed from the housing 301, the puncher 31 is moved to the outside of the housing 301. The sheet insertion opening 311 of the puncher 31 faces the upper side. As shown in FIG. 10, a guide slit 74 in which the sheets S can be inserted is provided in the upper surface of the punch box 71. When the sheets S are inserted from the guide slit 74, punch holes are made by the puncher 31.

Even when the punch box 71 is removed from the housing 301, since the main body of the finisher 200 and the puncher 31 are electrically connected by a cable, punching is executed by a user operating the operation unit 14 to send an instruction for punching to the finisher 200. Alternatively, also possible to attach a sensor to the puncher 31, detect, with the sensor, that sheets are inserted into the insertion opening 311 when the puncher 31 is rotating upward, and automatically punch the sheets.

As shown in FIG. 10, windows 75 are provided on both the sides of the punch box 71 such that the sheets S can be conveyed when the punch box 71 is housed in the housing 301. The sheets S are inserted into the insertion opening 311 of the puncher 31 through the windows 75. After punching, the sheets S can pass in the conveying direction (the arrow Z direction).

A cutout 76 is provided at the end on the inner side of the punch box 71. In order to rotate the puncher 31 to an original position when the removed punch box 71 is housed again, a sloped platform 38 (FIG. 11) is provided in the housing 301. The platform 38 is opposed to the position of the cutout 76.

A movable bumping plate 37 is provided between the puncher 31 and the dust box 32. FIGS. 9A to 9D are diagrams for explaining operation of the rotation of the puncher 31 and the movement of the bumping plate 37 involved in the removal of the punch box 71 from the housing 301. A transmitting mechanism 80 is provided in the punch box 71 in order to move the bumping plate 37 according to the rotation of the puncher 31. However, in FIGS. 9A to 9D, the transmitting mechanism is simplified.

Figure 9A:
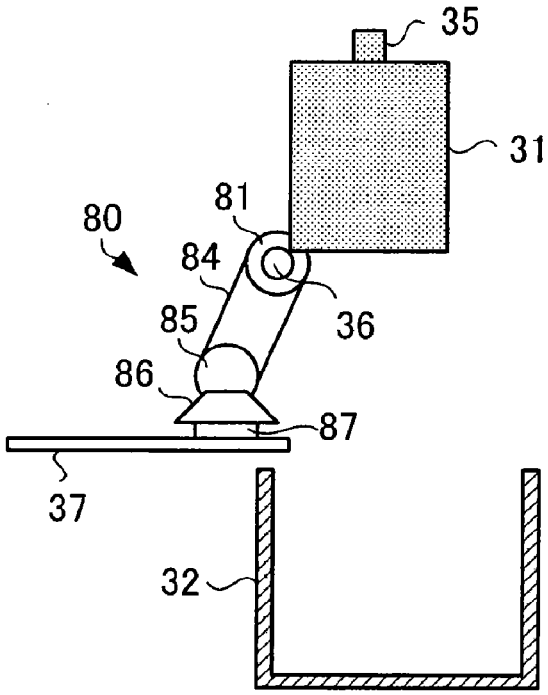
FIGS. 9A, 9B, 9C, and 9D are diagrams for explaining the rotating operation of the punch unit.
Figure 9B:
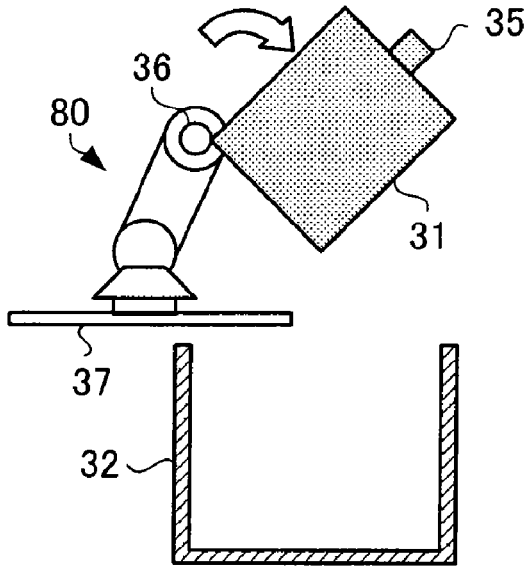
Figure 9C:
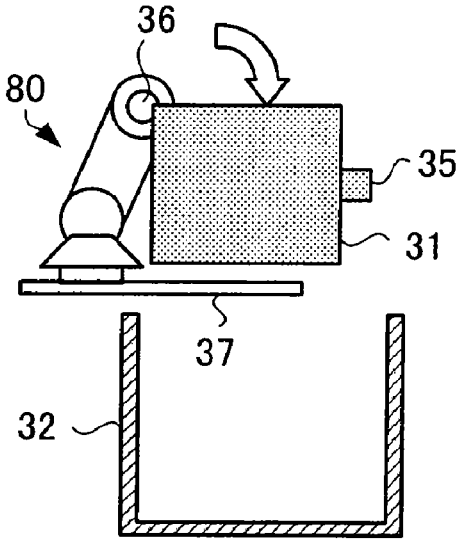

In FIG. 9A, a state in which the puncher 31 is housed in the housing 301 is shown. The bumping plate 37 is present on the dust box 32. When the punch box 71 is removed from the housing 301, as shown in FIGS. 9B and 9C, the puncher 31 rotates with own weight and the shaft 36 also rotates. The bumping plate 37 projects to the lower side of the puncher 31 according to the rotation of the puncher 31.

Figure 9D:
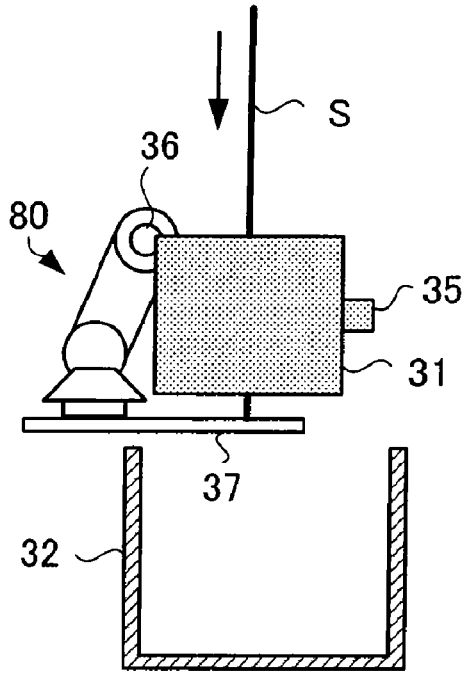

In FIG. 9D, a state in which the puncher 31 rotates, the bumping plate 37 projects to the lower side of the puncher 31, and the sheets S are inserted into the insertion opening 311 of the puncher 31 is shown. Since the leading end of the sheets S bumps against the bumping plate 37, punch holes can be made in accurate positions. The bumping plate 37 prevents the sheets S from falling to the dust box 32.

Figure 11:
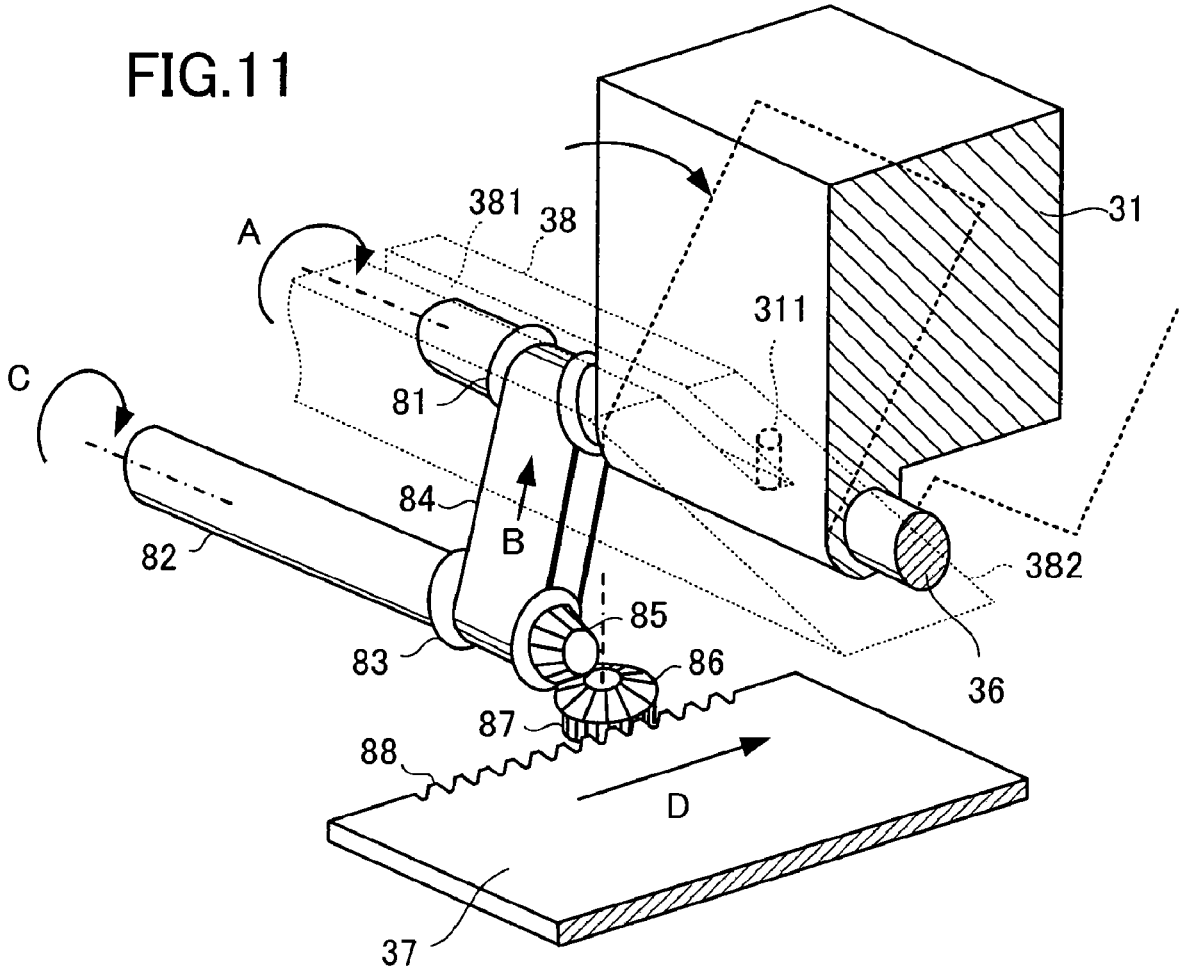
FIG. 11 is a perspective view of a rotating mechanism for the punch unit.

FIG. 11 is a perspective view of an example of the transmitting mechanism 80. The transmitting mechanism 80 transmits the rotation of the puncher 31 to the bumping plate 37 and moves the bumping plate 37. The transmitting mechanism 80 includes a pulley 81 attached to the shaft 36, a shaft 82 provided in parallel to the shaft 36 a distance apart from the shaft, a pulley 83 attached to the shaft 82, and an annular belt 84 laid over between the pulley 81 and the pulley 83.

A bevel gear 85 is provided at the end in the axis direction of the pulley 83. A bevel gear 86 is provided orthogonal to the bevel gear 85. The bevel gears 85 and 86 rotate in mesh with each other. A gear 87 is formed in a shaft section of the bevel gear 86. The gear 87 meshes with a rack 88 formed in the bumping plate 37.

In FIG. 11, only the end on the inner side of the puncher 31 is shown. However, the puncher 31 can rotate around the shaft 36. When the punch box 71 is housed in the housing 301, the bottom of the puncher 31 is placed on the platform 38 (indicated by a dotted line) provided in the housing 301. The platform 38 has a configuration same as that of the platform 68 shown in FIG. 5. A slope 382 is formed at the distal end of the platform 38. A guide pin 311 is provided at the bottom of the puncher 31. The guide pin 311 fits in a groove rail 381.

When the punch box 71 is removed from the housing 301, the puncher 31 is also removed. The puncher 31 gradually falls along the slope 381 of the platform 38 and rotates around the shaft 36 with own weight. Since the shaft 36 rotates together with the puncher 31, the pulley 81 rotates and the pulley 83 and the belt 84 rotate in association with the pulley 81.

According to the rotation of the pulley 83, the bevel gears 85 and 86 rotate in mesh with each other, the gear 87 rotates in mesh with the rack 88 formed in the bumping plate 37, and the bumping plate 37 moves. Arrows A, B, and C indicate respective rotating directions of the shaft 36, the belt 84 and the shaft 82. An arrow D indicates a moving direction of the bumping plate 37.

When the punch box 71 is housed in the housing 301, the puncher 31 rotates to rise along the slope 381 and rotate or move in opposite directions of the arrows A, B, C, and D. The puncher 31 and the bumping plate 37 return to original states (FIGS. 7 and 9A).

According to the second embodiment, when the punch box 71 is removed, the puncher 31 is also removed to the outside of the housing 301 and the insertion opening 311 of the puncher 31 faces the upper side. Therefore, since the sheets S are inserted from the upper side of the punch box 71 and punched, the sheets S are easily punched.

Figure 12:
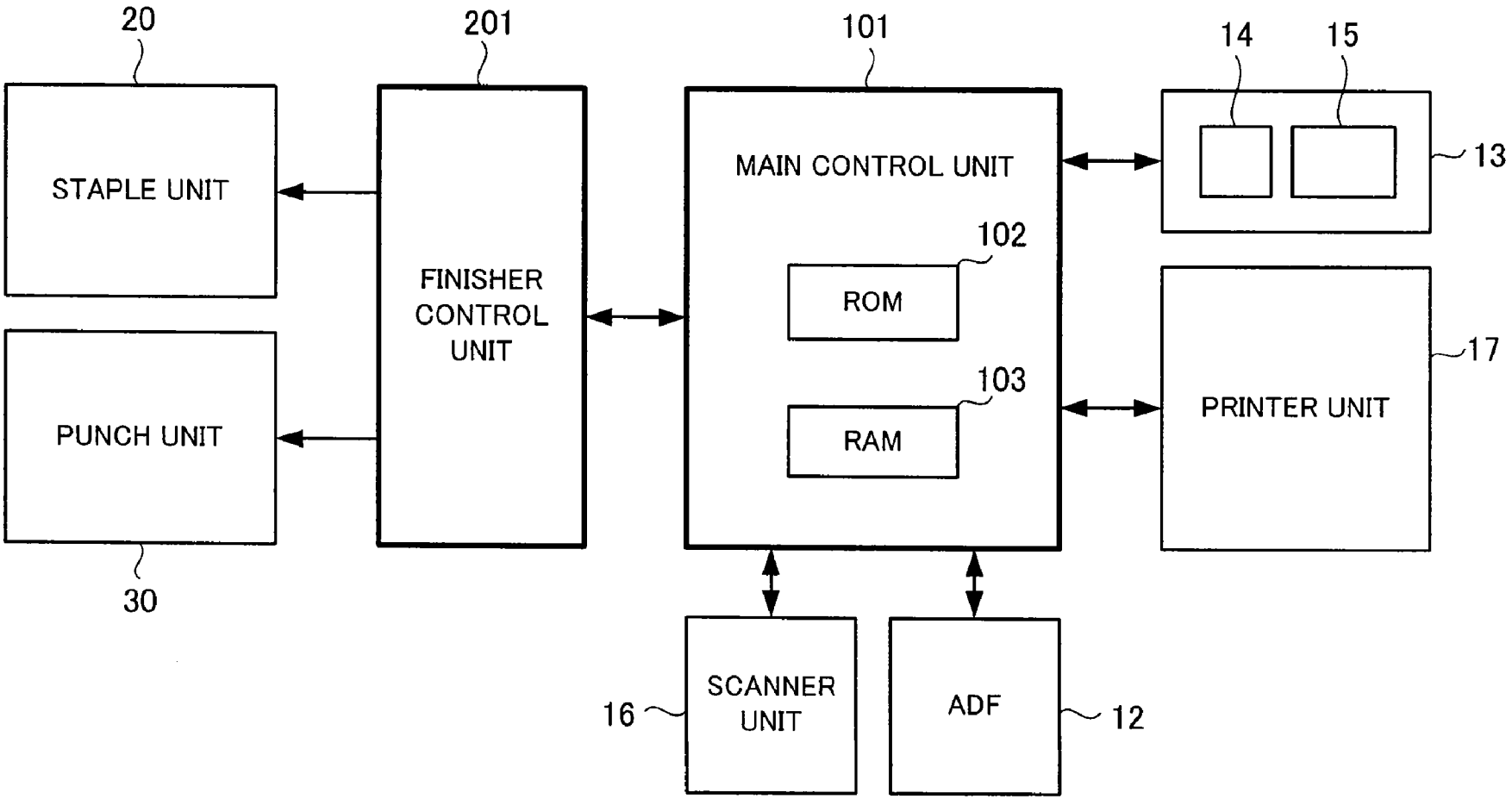
FIG. 12 is a block diagram of a control system for the sheet finishing apparatus.

FIG. 12 is a block diagram of a control system for the image forming apparatus 100 and the finisher 200.

In FIG. 12, a main control unit 101 includes a CPU, a ROM 102, and a RAM 103. The main control unit 101 controls the image forming apparatus 100 according to a control program stored in the ROM 102. The main control unit 101 controls the operation of the ADF 12, the scanner unit 16, and the printer unit 17 in response to the operation of the operation panel 13. The RAM 103 is used for temporary storage of control data and arithmetic work during control.

The operation panel 13 includes the plural keys 14 and the display unit 15 also serving as a touch panel. The user can give various instructions for image formation to the image forming apparatus 100 through the operation panel 13. For example, the user gives an instruction concerning the number of copies using the keys 14 and gives instructions concerning a sheet size, a sheet type, stapling, and punching by operating the touch panel of the display unit 15.

A finisher control unit 201 controls the operation of the finisher 200. The finisher control unit 201 is connected to the main control unit 101 and performs transmission of information with the main control unit 101. The image forming apparatus 100 and the finisher 200 operate in cooperation with each other. The finisher control unit 201 controls the staple unit 20 and the punch unit 30.

The control of the staple unit 20 includes control of the position of the stapler 25, implementation of stapling, conveyance of the sheets S to the stapler 25, and discharge of a sheet bundle after stapling. The control of the punch unit 30 includes lifting and lowering of the punching blades 35, conveyance of the sheets S to the puncher 35, and carry-out of the sheets S after punching.

The present invention is not limited to the embodiments explained above. Various modifications of the embodiments are possible without departing from the scope of claims.

Although exemplary embodiments are shown and described, it will be apparent to those having ordinary skill in the art that a number of changes, modifications, or alterations as described herein may be made, none of which depart from the spirit. All such changes, modifications, and alterations should therefore be seen as within the scope.

What is claimed is:

1. A sheet finishing apparatus comprising:
a tray that supports sheets;
a housing that supports the tray;
a stapler that staples the sheets, which are supported by the tray, in a sheet insertion opening extending in a direction along the sheets in the housing;
a driving mechanism that moves the stapler in a direction orthogonal to a conveying direction of the sheets and removes the stapler to an outside of the housing; and
a rotating mechanism that rotates, when the stapler is removed to the outside of the housing, the stapler such that the sheet insertion opening of the stapler faces a further upper side than the direction along the sheets.

2. The apparatus of claim 1, further comprising: a box that can be removed from and inserted into the housing and covers the stapler removed to the outside of the housing.

3. The apparatus of claim 2, wherein a guide section that guides sheets to the sheet insertion opening of the stapler removed to the outside of the housing is formed in the box.

4. The apparatus of claim 2, wherein the driving mechanism moves the stapler to the outside of the housing in response to the removal of the box.

5. The apparatus of claim 1, wherein the driving mechanism moves, when the stapler is housed in the housing, the stapler along an end edge of the conveyed sheets and staples a specified position of the sheets.

6. The apparatus of claim 1, wherein
the driving mechanism includes a stepping motor that moves the stapler, and
the stepping motor is deenergized when the stapler moves to the outside of the housing.

7. The apparatus of claim 1, wherein the rotating mechanism for the stapler includes:
a columnar shaft arranged to extend in a moving direction of the stapler;
a rail arranged in parallel to the shaft and formed a slope that descends toward a direction in which the stapler is removed from the housing;
a slave that moves along the shaft, which pierces through the slave, and is rotatable around the shaft; and
a stage integrally formed with the slave and the stapler moving on the rail is attached on.

8. A sheet finishing method comprising:
providing a tray that supports sheets in a housing;
providing a stapler that staples the sheets, which are supported by the tray, in a sheet insertion opening extending in a direction along the sheets in the housing;
moving the stapler in a direction orthogonal to a conveying direction of the sheets and removing the stapler to an outside of the housing; and
rotating, when the stapler is removed to the outside of the housing, the stapler such that the sheet insertion opening of the stapler faces a further upper side than the direction along the sheets.

9. The method of claim 8, further comprising:
providing a box that can be removed from and inserted into the housing and covers the stapler removed to the outside of the housing; and
forming a guide section in the box to guide sheets to the sheet insertion opening of the stapler removed to the outside of the housing.

10. The method of claim 9, further comprising moving the stapler to the outside of the housing in response to the removal of the box.

11. The method of claim 8, further comprising moving, when the stapler is housed in the housing, the stapler along an end edge of the conveyed sheets and stapling a specified position of the sheets.

12. The method of claim 8, further comprising:
providing a stepping motor that moves the stapler; and
deenergizing the stepping motor when the stapler moves to the outside of the housing.

13. The method of claim 8, further comprising:
arranging a columnar shaft extending in a moving direction of the stapler;
providing, in parallel to the shaft, a rail formed a slope that descends toward a direction in which the stapler is removed from the housing;
moving, along the shaft, a slave that is rotatable around the shaft;
moving, on the rail, a stage integrally formed with the slave; and
placing the stapler on the stage and rotating the stapler when the stage passes on the slope.

14. An image forming apparatus comprising:
an image forming unit that forms images on sheets;
a tray that supports the sheets conveyed from the image forming unit;
a housing that supports the tray;
a stapler that staples the sheets, which are supported by the tray, in a sheet insertion opening extending in a direction along the sheets in the housing;
a driving mechanism that moves the stapler in a direction orthogonal to a conveying direction of the sheets and removes the stapler to an outside of the housing; and
a rotating mechanism that rotates, when the stapler is removed to the outside of the housing, the stapler such that the sheet insertion opening of the stapler faces a further upper side than the direction along the sheets.

15. The apparatus of claim 14, further comprising: a box that can be removed from and inserted into the housing and covers the stapler removed to the outside of the housing.

16. The apparatus of claim 15, wherein a guide section that guides sheets to the sheet insertion opening of the stapler removed to the outside of the housing is formed in the box.

17. The apparatus of claim 15, wherein the driving mechanism moves the stapler to the outside of the housing in response to the removal of the box.

18. The apparatus of claim 14, wherein the driving mechanism moves, when the stapler is housed in the housing, the stapler along an end edge of the conveyed sheets and staples a specified position of the sheets.

19. The apparatus of claim 14, wherein
the driving mechanism includes a stepping motor that moves the stapler, and
the stepping motor is deenergized when the stapler moves to the outside of the housing.

20. The apparatus of claim 14, wherein the rotating mechanism for the stapler includes:
a columnar shaft arranged to extend in a moving direction of the stapler;
a rail arranged in parallel to the shaft and formed a slope that descends toward a direction in which the stapler is removed from the housing;
a slave that moves along the shaft, which pierces through the slave, and is rotatable around the shaft; and
a stage integrally formed with the slave and the stapler moving on the rail is attached on.

* * * * *